US007918444B2

(12) United States Patent
Balahan et al.

(10) Patent No.: US 7,918,444 B2
(45) Date of Patent: Apr. 5, 2011

(54) MEDIA HANDLING DEVICE HAVING MEDIA SHINGLING MECHANISM FOR PROVIDING UNIFORM INTER-PAGE GAP BETWEEN SUCCESSIVE MEDIA SHEETS

(75) Inventors: Kim Limpahan Balahan, Dumaguete (PH); Mark Henry Perez De Leon, Bataan (PH); Roderick Fulgueras Jabello, Sagay (PH); Arnold Alberto Peregrino, Cagayan de Oro (PH); John Anthony Schmidt, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 263 days.

(21) Appl. No.: 12/171,854

(22) Filed: Jul. 11, 2008

(65) Prior Publication Data

US 2010/0007079 A1 Jan. 14, 2010

(51) Int. Cl.
*B65H 1/22* (2006.01)

(52) U.S. Cl. ..... 271/37; 271/145

(58) Field of Classification Search ..... 271/145, 271/105, 37, 135

See application file for complete search history.

(56) References Cited

U.S. PATENT DOCUMENTS 6,053,492 A * 4/2000 Newsome ..... 271/94
6,286,827 B1 * 9/2001 Meetze et al. ..... 271/162
6,644,502 B2 * 11/2003 Pearce et al. ..... 221/127

FOREIGN PATENT DOCUMENTS

JP 05105243 A * 4/1993

* cited by examiner

*Primary Examiner* — Stefanos Karmis
*Assistant Examiner* — Michael C McCullough

(57) ABSTRACT

A media handling device includes a media shingling mechanism having a roller actuator located adjacent an upper portion of a media stack and upstream thereof relative to a predetermined direction of an uppermost sheet from the stack toward a media restraint dam located downstream thereof. The roller actuator undergoes counterclockwise rotation in response to upward moving contact by successive sheets in the upper portion of the stack against a peripheral segment of the roller actuator as the stack is moved vertically upward in a rectilinear direction toward the roller actuator. The counterclockwise rotation of the roller actuator and upward movement of the upper portion of the stack produces a lateral displacement of successive sheets toward the dam so as to produce shingling of successive sheets of the upper portion of the stack relative to one another, providing a uniform inter-page gap between successive sheets.

20 Claims, 3 Drawing Sheets

MEDIA HANDLING DEVICE HAVING MEDIA SHINGLING MECHANISM FOR PROVIDING UNIFORM INTER-PAGE GAP BETWEEN SUCCESSIVE MEDIA SHEETS

BACKGROUND

1. Field of the Invention

The present invention relates generally to high capacity media handling devices and, more particularly, to a media handling device having a media shingling mechanism for providing a uniform inter-page gap between successive media sheets.

2. Description of the Related Art

Demand in the market for high capacity media handling devices is ever increasing due to the flexibility of these devices. This attribute is a great help for customers as different media can be selected and used with these devices. Additionally, this allows for greater volumes of media to be loaded into these devices. As the ability to produce greater amounts of output in a short period of time increase, the need for input devices that can feed a high volume of media without needing refilling is also increasing. However, these high capacity input devices need a mechanism to lift and effectively present the media to the pick or feeding mechanism.

Motor driven elevator mechanisms have been used heretofore in order to elevate a stack of media to the feeding mechanism that picks and presents one sheet of media at a time to the machine that will produced a processed output, whether it be printed, copied, scanned or faxed media. However, a problem exists with the use of this elevator mechanism if a dam is used as the media restraint mechanism. As the elevator goes up, the media stack moves vertically in rectilinear fashion which creates a subsequent problem during preparation of the top portion of the media stack for picking in conjunction with a media restraint dam. The problem is the variation in the inter-page gap produced between successive sheets as they are moved past the dam from the top of the vertically elevated stack.

Media handling devices currently attempt to solve this problem by providing a back restraint with an inclined planar surface that is used to guide the sheets of media laterally to the dam in preparation for picking in the feeding process. However, the use of the inclined surface on the back restraint in conjunction with a motor-driven elevator mechanism will result in a potential large frictional resistance between the inclined surface and the media stack traveling upwardly. This will result in a requirement for a higher motor capacity or, in a worst case, the motor stalling. In addition, possible damage to the media may occur.

Thus, there is still a need for an innovation that will provide a solution to the aforementioned problem that will avoid adverse impact on the capacity of the elevator motor.

SUMMARY OF THE INVENTION

The present invention meets this need by providing an innovation in a media handling device that avoids the frictional resistance situation between the inclined surface of the back restraint and the media stack moving vertically upward and thus eliminates the requirement for higher motor capacity. Furthermore, the innovation is more reliable compared to the back restraint in solving the problem of effective preparation of the media for feeding. The back restraint with the inclined surface has the tendency to cause media movement in grouped clumps instead of the required uniformly shingled sheets. This grouping creates a non-uniform inclined profile whereas the innovation will produce a uniform single page movement which means the media will transform into a smooth inclined profile parallel to that of the dam. The grouped non-uniform inclined profile is the main contributor to the variable inter-page gap problem. The innovation also results in a uniform distance between the media and the dam resulting in a smooth, low friction, transition without buckling of the media. Any buckling would also cause problematic inter-page gap problems. Also, the invention reduces multiple media feeding errors by pre-shingling the possible joined media sheet per sheet early in the media feeding preparations. Joined media results from the bulk media cutting manufacturing process which increases the chance of media joining together through media fiber entanglement. In summary, the present invention provides an innovation in the form of a media shingling mechanism in a media handling device that produces substantially uniform inter-page gaps or increments between successive media sheets in preparation for feeding the sheets to the subsequent media processes, such as printing, copying, scanning and/or faxing sheets of media.

Accordingly, in an aspect of the present invention, a media handling device includes a media input mechanism for lifting a stack of media sheets upward in a vertical rectilinear direction to move an upper portion of the stack to a predetermined elevation at which successive uppermost sheets of the stack are positioned for repetitive removal from the stack in a predetermined transverse direction relative to the vertical rectilinear direction, a media restraint dam positioned adjacent to the upper portion of the stack generally downstream thereof relative to the predetermined transverse direction, and a media shingling mechanism positioned adjacent to the upper portion of the stack and generally upstream thereof relative to the predetermined transverse direction and spaced apart from and in an opposing relationship to the media restraint dam relative to the upper portion of the stack such that the upper portion of the stack is positioned between the media shingling mechanism and the media restraint dam. The media shingling mechanism includes a rotatable roller actuator mounted for undergoing counterclockwise rotation, from a frame of reference at the right of the roller actuator, in response to upward moving contact by successive sheets in the upper portion of the stack against a peripheral segment of the rotatable roller actuator as the stack is moved vertically upward toward the rotatable roller actuator such that the counterclockwise rotation of the rotatable roller actuator and upward movement in the vertical rectilinear direction of the upper portion of the stack produces a lateral displacement of successive sheets toward the media restraint dam so as to produce a shingling of the successive sheets of the upper portion of the stack relative to one another that thereby provides a substantially uniform inter-page gap between successive sheets for enabling consistent repetitive removal of successive uppermost sheets from the stack.

In another aspect of the present invention, the media handling device includes a media input mechanism for lifting a stack of media sheets upward in a vertical rectilinear direction to move an upper portion of the stack to a predetermined elevation at which successive uppermost sheets of the stack are positioned for repetitive removal from the stack in a predetermined transverse direction relative to the vertical rectilinear direction, a media restraint dam positioned adjacent to the upper portion of the stack generally downstream thereof relative to the predetermined transverse direction, the media restraint dam having a first inclined surface adjacent to the upper portion of the stack that is inclined at an obtuse angle to the vertical rectilinear direction, and a media shingling mechanism positioned adjacent to the upper portion of the stack and generally upstream thereof relative to the predetermined transverse direction and spaced apart from and in an opposing relationship to the media restraint dam relative to the upper portion of the stack such that the upper portion of the stack is positioned between the media shingling mechanism and the media restraint dam. The media shingling mechanism includes a stationary upright frame member and a rotatable roller actuator mounted on the stationary upright frame member for undergoing counterclockwise rotation, from a frame of reference at the right of the roller actuator, in response to upward moving contact by successive sheets in the upper portion of the stack against a peripheral segment of the rotatable roller actuator as the stack is moved vertically upward toward the rotatable roller actuator such that the counterclockwise rotation of the rotatable roller actuator and upward movement in the vertical rectilinear direction of the upper portion of the stack produces a lateral displacement of successive sheets toward the media restraint dam so as to produce a shingling of the successive sheets of the upper portion of the stack relative to one another that thereby provides a substantially uniform inter-page gap between successive sheets for enabling their repetitive removal from the stack.

BRIEF DESCRIPTION OF THE DRAWINGS

Figure 1:
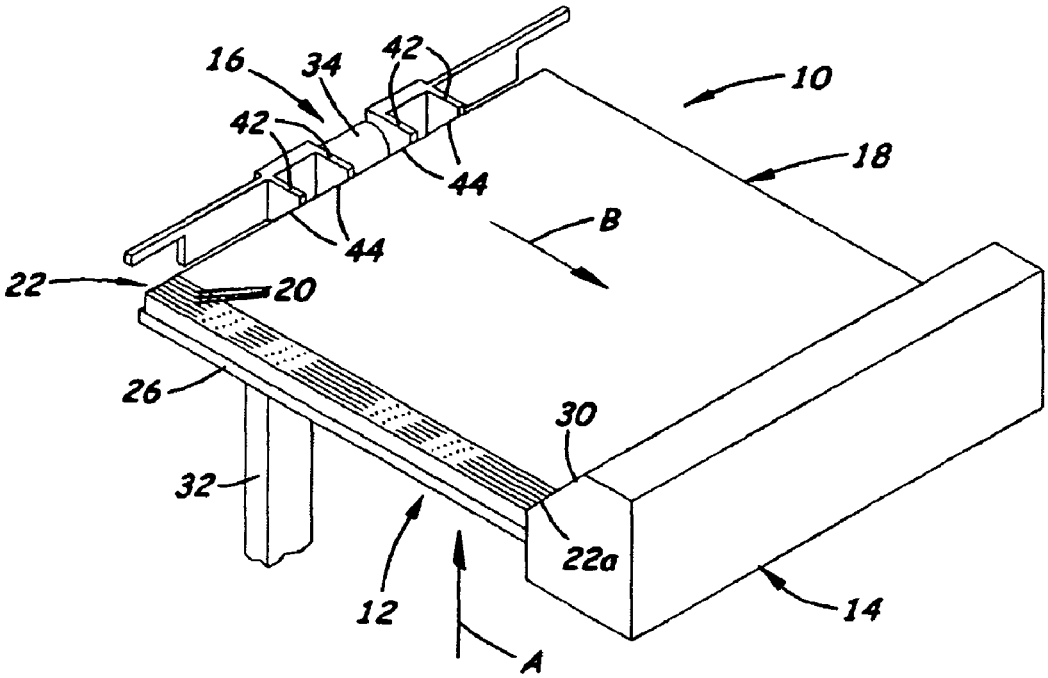

Having thus described the invention in general terms, reference will now be made to the accompanying drawings, which are not necessarily drawn to scale, and wherein:

FIG. 1 is a perspective view of an exemplary embodiment of a media handling device having, in combination, a media input mechanism, a media restraint dam and a media shingling mechanism according to the present invention.

Figure 2:
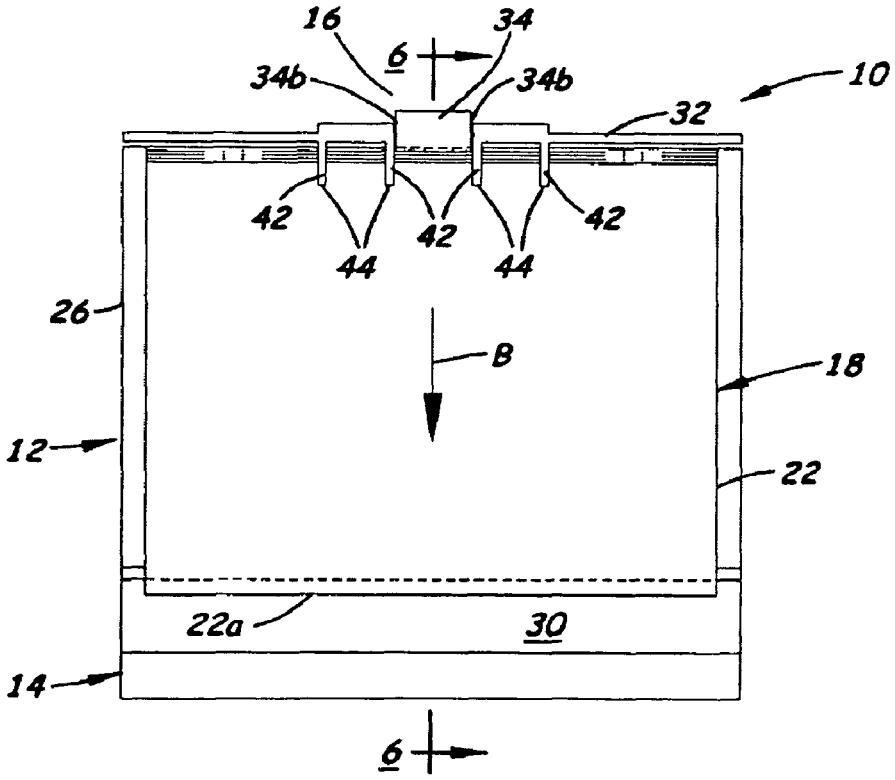

FIG. 2 is a top plan view of the media handling device of FIG. 1.

Figure 3:
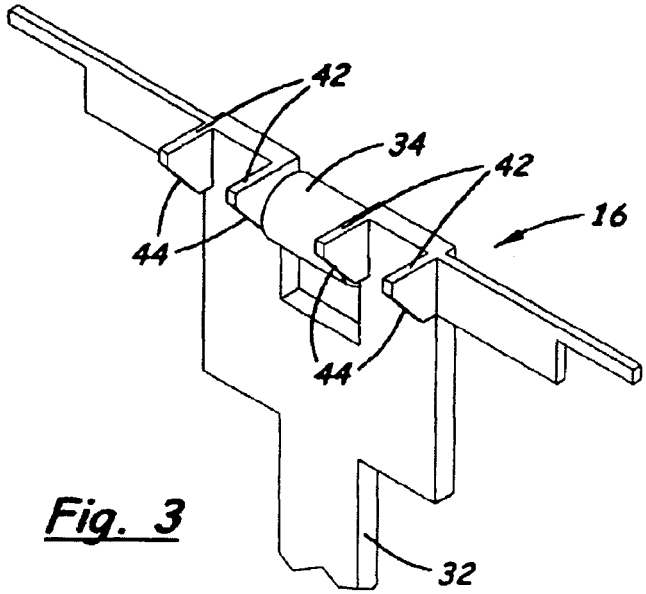

FIG. 3 is an enlarged perspective view of the media shingling mechanism of the media handling device.

Figure 4:
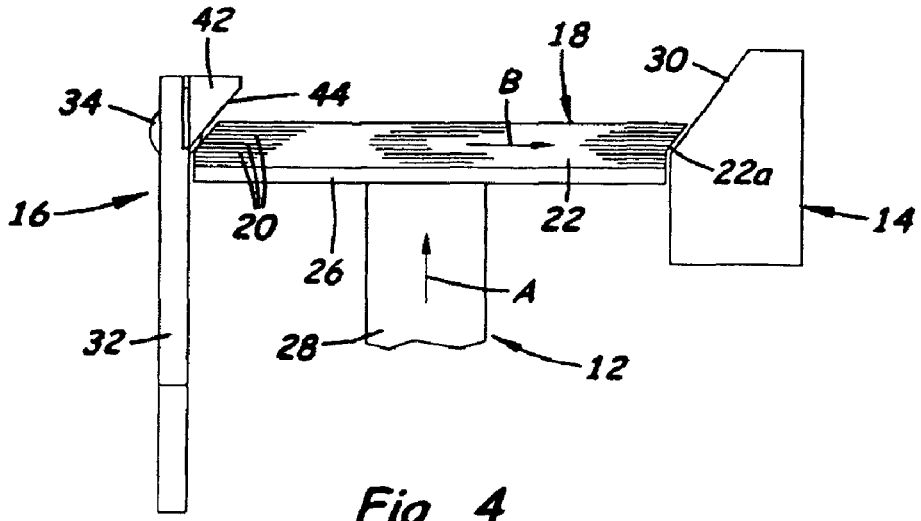

FIG. 4 is a side elevational view of the media handling device as seen along line 4-4 of FIG. 2.

Figure 5:
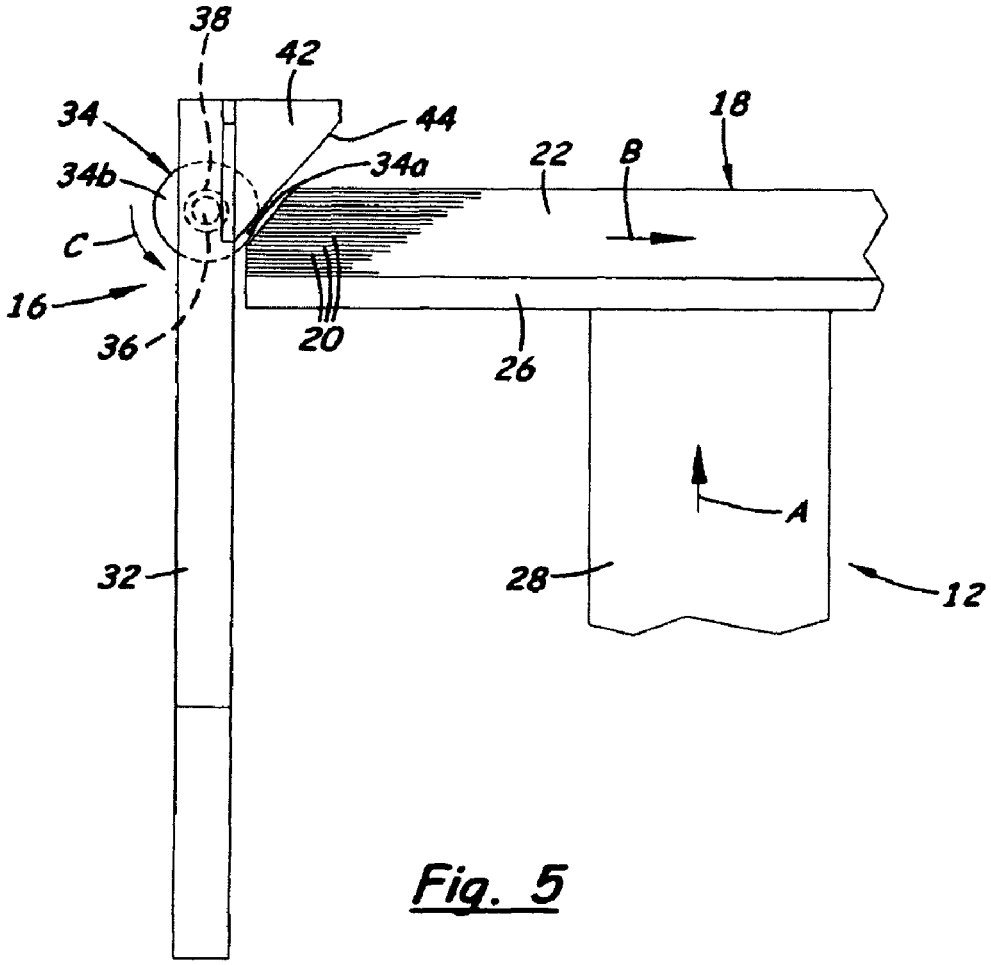

FIG. 5 is an enlarged fragmentary view of the media handling device shown in FIG. 4.

Figure 6:
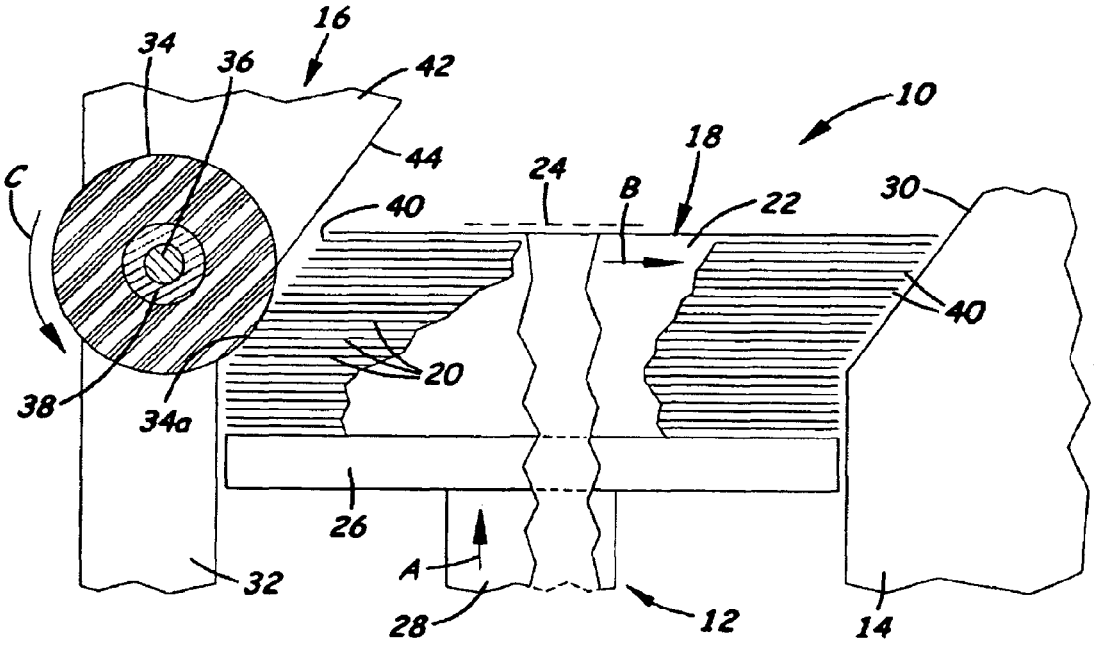

FIG. 6 is an enlarged foreshortened sectional view of the media handling device taken along line 6-6 of FIG. 2 showing the shingling of the sheets of media in the top portion of the stack.

DETAILED DESCRIPTION

The present invention now will be described more fully hereinafter with reference to the accompanying drawings, in which some, but not all embodiments of the invention are shown. Indeed, the invention may be embodied in many different forms and should not be construed as limited to the embodiments set forth herein; rather, these embodiments are provided so that this disclosure will satisfy applicable legal requirements. Like numerals refer to like elements throughout the views.

Referring now to FIGS. 1-4, there is illustrated a media handling device, generally designated 10, of the present invention which includes a media input mechanism 12, a media restraint dam 14, and a media shingling mechanism 16. The media input mechanism 12 is operable for lifting a stack 18 of media sheets 20 upward in a vertical rectilinear direction, as per arrow A, to move an upper portion 22 of the stack 18 to a predetermined elevation 24. At such elevation 24, the successive uppermost sheets 20 of the stack 18 are positioned for repetitive removal from the stack 18 in a predetermined transverse direction, as per arrow B, by a suitable pick or feed mechanism (not shown), relative to the vertical rectilinear direction A.

More particularly, the media input mechanism 12 includes a floor or platform 26 for supporting the stack 18 of media sheets 20, and an elevator 28 for drivingly moving the platform 26 upward in the vertical rectilinear direction A. In such manner, the elevator 28 moves the upper portion 22 of the stack 18 to the predetermined elevation 24 at which successive uppermost sheets 20 of the stack 18 are positioned for repetitive removal from the stack 18 in a predetermined transverse direction B. The media restraint dam 14 is positioned adjacent to the upper portion 22 of the stack 18 generally downstream of the stack 18 along or relative to the predetermined transverse direction B. The media restraint dam 14 has a first inclined surface 30 adjacent the upper portion 22 of the stack 18 that is inclined at a desired obtuse angle to the vertical rectilinear direction A.

Referring now to FIGS. 1-6, the media shingling mechanism 16 of the media handling device 10 is positioned adjacent to the upper portion 22 of the stack 18 and generally upstream of the stack 18 along or relative to the predetermined transverse direction B. The media shingling mechanism 16 is thereby spaced apart from and in an opposing relationship to the media restraint dam 14 relative to the upper portion 22 of the stack 18 such that the upper portion 22 of the stack 18 is positioned between the media shingling mechanism 16 and the media restraint dam 14.

More particularly, the media shingling mechanism 16 includes a stationary back restraint upright frame member 32 and a rotatable roller actuator 34, for example of substantially cylindrical configuration and constituted as a non-driven passive element, located adjacent to the upper portion 22 of the stack 18. The roller actuator 34 is suitably rotatably mounted to the frame member 32, for example by an axle 36 and a suitable low friction bearing 38, so that the roller actuator 34 is able to undergo rotation in a free-wheeling manner. The roller actuator 34 will undergo rotation in a counterclockwise direction, as per arrow C in FIGS. 5 and 6, when engaged, due to upward moving contact by successive sheets 20 in the upper portion 22 of the stack 18, at a peripheral segment 34*a* of the roller actuator 34, such as between six o'clock and three o'clock positions thereon, as the elevator platform 26 and the stack 18 thereon are moved upward in the vertical rectilinear direction A toward the roller actuator 34. Such rotation in the counterclockwise direction C of the roller actuator 34 caused by upward movement in the vertical rectilinear direction A of the upper portion 22 of the stack 18 produces a lateral displacement of the successive sheets 20 of the upper portion 22 of the stack 18 in the predetermined transverse direction B toward the first inclined surface 30 of the media restraint dam 14 so as to produce a substantially uniform shingling of the successive sheets 20 of the upper portion 22 of the stack 18 relative to one another. The substantially uniform shingling of the successive sheets 20 provides a substantially uniform inter-page gap 40 between the successive sheets 20 due to a continuous transformation of the movement of the upper portion 22 of the stack 18 from the vertical rectilinear direction A to the transverse or lateral diagonal direction B which results in the upper portion 22 of the stack 18 assuming an angular profile matching that of the first inclined surface 30 on the media restraint dam 14, as best seen in FIGS. 5 and 6.

The media shingling mechanism 16 further includes at least one and preferably a plurality of spaced apart side-by-side guide members 42, such as in the form of substantially parallel-extending ribs, also mounted to the stationary back restraint upright frame member 32 adjacent to opposite lateral sides 34*b* of the roller actuator 34 and to the upper portion 22 of the stack 18. The guide members 42 have defined thereon, and facing toward the upper portion 22 of the stack 18, second inclined surface portions 44 coplanar with one another and extending substantially parallel to the first inclined surface 30 of the media restraint dam 14. The guide members 42 are positioned relative to the roller actuator 34 so as to prevent any one of the sheets 20 in the upper portion 22 of the stack 18 from clinging to the roller actuator 34 past an approximate three o'clock position on the peripheral segment 34*a* of the roller actuator 34 during its counterclockwise rotation.

As best seem in FIGS. 4-6, the roller actuator 34 of the media shingling mechanism 16 in accordance with the present invention moves every single page or sheet 20 of media laterally and diagonally, generally in the predetermined transverse direction B, to provide the top portion 22 of the stack 18 with a profile that closely matches the obtuse angle of the media restraint dam 14, as mentioned previously. The resulting profile of the top portion 22 of the stack 18 of media sheets 20 is the desired outcome achieved by the media shingling mechanism 16 of the media handling device 10 in accordance with the present invention in that it provides a satisfactory solution to the problem of the proper preparation of the media sheets 20 for picking and feeding to subsequent processes. More particularly, as the elevator platform 26 and the stack 18 therewith go up, the first uppermost sheet touches (makes moving contact with) the roller actuator 34, causing the roller actuator 34 to rotate in the counterclockwise direction C, which feeds the sheet 20 laterally toward the media restraint dam 14. As each succeeding sheet 20 is pushed laterally in the same manner by the rotation of the roller actuator 34, they carry the first sheet 20 and each succeeding sheet 20 with them since as each succeeding sheet 20 is pushed laterally it carries the sheets 20 above it laterally with it. This continues until eventually the leading edge 22*a* of the upper portion 22 of the stack 18, as formed by all of the sheets 20 of the upper portion 22 of the stack 18, becomes aligned parallel to the media restraint dam 14 as seen in FIGS. 4 and 6. This will result in a diagonal profile in which the sheets 20 are now ready for picking without any timing problem that would come up in the case where the upper portion 22 of the stack 18 has a vertical profile. The vertical profile creates a large gap between the stack 18 and the media restraint dam 14. The larger the gap between them, the faster a sheet 20 will accelerate as it is picked by the picking mechanism (not shown) because the sheet 20 will contact virtually nothing to resist or impede this acceleration. This results in the feed of the sheet 20 arriving too early at its destination and also further produces the inter-page gap problem mentioned hereinbefore.

Furthermore, the stationary upright frame member 32 could be used as side restraint rather than a back restraint. The roller actuator 34 and guide members 42 could then be applied as part of the side restraint and side guides respectively.

The foregoing description of several embodiments of the invention has been presented for purposes of illustration. It is not intended to be exhaustive or to limit the invention to the precise forms disclosed, and obviously many modifications and variations are possible in light of the above teaching. It is intended that the scope of the invention be defined by the claims appended hereto.

What is claimed is:

1. A media handling device, comprising:

a media input mechanism for lifting a stack of media sheets upward in a vertical rectilinear direction to move an upper portion of the stack to a predetermined elevation at which successive uppermost sheets of the stack are positioned for repetitive removal from the stack in a predetermined transverse direction relative to the vertical rectilinear direction;

a media restraint dam positioned adjacent to the upper portion of the stack generally downstream thereof relative to the predetermined transverse direction; and a media shingling mechanism positioned adjacent to the upper portion of the stack and spaced apart from and in an opposing relationship to said media restraint dam relative to the upper portion of the stack such that the upper portion of the stack is positioned between said media shingling mechanism and said media restraint dam, said media shingling mechanism including a rotatable roller actuator mounted for undergoing rotation about a stationary axis in response to upward moving contact by successive sheets in the upper portion of the stack against a peripheral segment of said rotatable roller actuator as the stack is moved vertically upward toward said media shingling mechanism such that the counterclockwise rotation of said rotatable roller actuator and upward movement in the vertical rectilinear direction of the upper portion of the stack produces a lateral displacement of successive sheets toward said media restraint dam so as to produce a shingling of the successive sheets of the upper portion of the stack relative to one another that thereby provides a substantially uniform inter-page gap between successive sheets for enabling a substantially consistent repetitive removal of successive uppermost sheets from the stack, said media shingling mechanism further including at least one stationary guide member mounted adjacent to said rotatable roller actuator and to the upper portion of the stack for preventing any one of the sheets in the upper portion of the stack from clinging to said rotatable roller actuator past an approximate three o'clock position of the rotation of said rotatable roller actuator.

2. The device of claim 1 wherein said peripheral segment of said rotatable roller actuator is contacted by successive sheets in the upper portion of the stack between approximate six and three o'clock positions on said rotatable roller actuator.

3. The device of claim 1 wherein said rotatable roller actuator is a non-driven passive element.

4. The device of claim 1 wherein said media input mechanism includes a platform for supporting the stack of media sheets.

5. The device of claim 4 wherein said media input mechanism further includes an elevator for moving said platform in the vertical rectilinear direction.

6. The device of claim 5 wherein said media restraint dam has a first inclined surface adjacent to the upper portion of the stack that is inclined at an obtuse angle to the vertical rectilinear direction and upon which is produced the shingling of leading ends of successive sheets of the upper portion of the stack relative to one another by said media shingling mechanism.

7. The device of claim 6 wherein said media shingling mechanism also includes a stationary upright frame member, said rotatable roller actuator being rotatably mounted to said upright frame member.

8. The device of claim 7 wherein said at least one guide member is mounted to said upright frame adjacent to said rotatable roller actuator and to the upper portion of the stack such that the moving contact between said rotatable roller actuator and each successive sheet in the upper portion of the stack is maintained for less than about forty-five degrees of one complete rotation of said rotatable roller actuator.

9. The device of claim 7 wherein said media shingling mechanism further includes a plurality of spaced apart side-by-side guide members mounted to said upright frame adjacent to opposite lateral sides of said rotatable roller actuator and adjacent to the upper portion of the stack, said plurality of spaced apart side-by-side guide members defining second inclined surface portions coplanar with one another and extending substantially parallel to said first inclined surface of said media restraint dam and positioned relative to said rotatable roller actuator for preventing any one of the sheets in the upper portion of the stack from clinging to said rotatable roller actuator past an approximate three o'clock position of the rotation of said rotatable roller actuator such that moving contact between said rotatable roller actuator and each successive sheet in the upper portion of the stack is maintained for less than about forty-five degrees of one complete rotation of said rotatable roller actuator.

10. The device of claim 1 wherein said media shingling mechanism also includes a stationary upright frame member, said rotatable roller actuator being rotatably mounted to said upright frame member.

11. The device of claim 10 wherein said media shingling mechanism further includes a plurality of spaced apart side-by-side stationary guide members mounted to said upright frame adjacent to opposite lateral sides of said rotatable roller actuator and adjacent to the upper portion of the stack, said plurality of spaced apart side-by-side guide members defining surface portions coplanar with one another and extending inclined at an acute angle toward the upper portion of the stack and relative to the vertical rectilinear direction and positioned relative to said rotatable roller actuator so as to prevent any one of the sheets in the upper portion of the stack from clinging to said rotatable roller actuator past an approximate three o'clock position of the rotation of said rotatable roller actuator such that the moving contact between said rotatable roller actuator and each successive sheet in the upper portion of the stack is maintained for less than about forty-five degrees of one complete rotation of said roller actuator.

12. A media handling device, comprising:

a media input mechanism for lifting a stack of media sheets upward in a vertical rectilinear direction to move an upper portion of the stack to a predetermined elevation at which successive uppermost sheets of the stack are positioned for repetitive removal from the stack in a predetermined transverse direction relative to the vertical rectilinear direction;

a media restraint dam positioned adjacent to the upper portion of the stack generally downstream thereof relative to the predetermined transverse direction, said media restraint dam having a first inclined surface adjacent to the upper portion of the stack that is inclined at an obtuse angle to the vertical rectilinear direction; and a media shingling mechanism positioned adjacent to the upper portion of the stack and spaced apart from and in an opposing relationship to said media restraint dam relative to the upper portion of the stack such that the upper portion of the stack is positioned between said media shingling mechanism and said media restraint dam, said media shingling mechanism including a stationary upright frame member, a rotatable roller actuator mounted on said stationary upright frame member for undergoing rotation along a stationary axis, in response to upward moving contact by successive sheets in the upper portion of the stack against a peripheral segment of said rotatable roller actuator as the stack is moved vertically upward toward said rotatable roller actuator such that the rotation of said rotatable roller actuator and upward movement in the vertical rectilinear direction of the upper portion of the stack produces a lateral displacement of successive sheets toward said media restraint dam so as to produce a shingling of the successive sheets of the upper portion of the stack relative to one another that thereby provides a substantially uniform inter-page gap between successive sheets for enabling their repetitive removal from the stack, and at least one stationary guide member mounted to said upright frame member adjacent to said rotatable roller actuator and to the upper portion of the stack for preventing any one of the sheets in the upper portion of the stack from clinging to said rotatable roller actuator past an approximate three o'clock position of the rotation of said rotatable roller actuator.

13. The device of claim 12 wherein said wherein said at least one guide member prevents any one of the sheets in the upper portion of the stack from clinging to said rotatable roller actuator past an approximate three o'clock position of the rotation of said rotatable roller actuator such that the moving contact between said rotatable roller actuator and each successive sheet in the upper portion of the stack is maintained for less than about forty-five degrees of one complete rotation of said rotatable roller actuator.

14. The device of claim 12, wherein said media shingling mechanism further includes a plurality of spaced apart side-by-side stationary guide members mounted to said upright frame member adjacent to opposite lateral sides of said rotatable roller actuator and adjacent to the upper portion of the stack, said guide members defining second inclined surface portions coplanar with one another and extending substantially parallel to said first inclined surface of said media restraint dam and positioned relative to said rotatable roller actuator so as to prevent any one of the sheets in the upper portion of the stack from clinging to said rotatable roller actuator past an approximate three o'clock position of the rotation of said rotatable roller actuator such that the moving contact between said rotatable roller actuator and each successive sheet in the upper portion of the stack is maintained for less than about forty-five degrees of one complete rotation of said rotatable roller actuator.

15. The device of claim 12 wherein said peripheral segment of said rotatable roller actuator of said media shingling mechanism is contacted by successive sheets in the upper portion of the stack between approximately six o'clock and approximately three o'clock positions on said rotatable roller actuator.

16. The device of claim 12 wherein said rotatable roller actuator is a non-driven passive element.

17. A media handling device, comprising:

a media input mechanism including a platform for supporting a stack of media sheets, and an elevator for drivingly moving said platform upward in a vertical rectilinear direction to move an upper portion of the stack to a predetermined elevation at which successive uppermost sheets of the stack are positioned for repetitive removal from the stack in a predetermined transverse direction relative to the vertical rectilinear direction;

a media restraint dam positioned adjacent to the upper portion of the stack generally downstream thereof relative to the predetermined transverse direction and having a first inclined surface adjacent the upper portion of the stack that is inclined at an obtuse angle to the vertical rectilinear direction; and a media shingling mechanism positioned adjacent to the upper portion of the stack and spaced apart from and in an opposing relationship to said media restraint dam relative to the upper portion of the stack such that the upper portion of the stack is positioned between said media shingling mechanism and said media restraint dam, said media shingling mechanism including a stationary upright frame member, a rotatable roller actuator of substantially cylindrical configuration mounted to said upright frame member adjacent to the upper portion of the stack for undergoing rotation about a substantially stationary axis, due to upward moving contact by successive sheets in the upper portion of the stack with a peripheral segment of said rotatable roller actuator as said platform and the stack thereon are moved upward in the vertical rectilinear direction toward said rotatable roller actuator such that the rotation of said rotatable roller actuator and upward movement in the vertical rectilinear direction of the upper portion of the stack produces a lateral displacement of the successive sheets of the upper portion of the stack toward the inclined surface of said media restraint dam so as to produce a shingling of the successive sheets of the upper portion of the stack relative to one another that thereby provides a substantially uniform inter-page gap between successive sheets due to a transformation of the movement of the upper portion of the stack from the vertical rectilinear direction to a lateral diagonal direction which results in the upper portion of the stack assuming an angular profile matching that of said inclined surface on said media restraint dam, and a plurality of spaced apart side-by-side stationary guide members mounted to said upright frame member adjacent to opposite lateral sides of said rotatable roller actuator and to the upper portion of the stack and defining second inclined surface portions substantially coplanar with one another and extending substantially parallel to said first inclined surface of said media restraint dam and being positioned relative to said rotatable roller actuator so as to prevent any one of the sheets in the upper portion of the stack from clinging to said rotatable roller actuator past an approximate three o'clock position of the rotation of said rotatable roller actuator.

18. The device of claim 17 wherein said peripheral segment of said rotatable roller actuator of said media shingling mechanism is contacted by successive sheets in the upper portion of the stack between approximately six o'clock and approximately three o'clock positions of said rotatable roller actuator.

19. The device of claim 17 wherein said rotatable roller actuator is a non-driven passive element.

20. The device of claim 17 wherein the moving contact between said peripheral segment of said rotatable roller actuator and each successive sheet in the upper portion of the stack is maintained for less than about forty-five degrees of one complete rotation of said rotatable roller actuator.

* * * * *